US012187977B2

(12) United States Patent
Kaneko

(10) Patent No.: US 12,187,977 B2
(45) **Date of Patent: *Jan. 7, 2025**

(54) WATER-GLYCOL HYDRAULIC FLUID

(71) Applicant: SHELL OIL COMPANY, Houston, TX (US)

(72) Inventor: Hiroshi Kaneko, Minato-ku (JP)

(73) Assignee: Shell USA, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/248,697

(22) PCT Filed: Nov. 9, 2021

(86) PCT No.: PCT/EP2021/081109

§ 371 (c)(1),
(2) Date: Apr. 12, 2023

(87) PCT Pub. No.: WO2022/101198

PCT Pub. Date: May 19, 2022

(65) Prior Publication Data

US 2023/0383214 A1 Nov. 30, 2023

(30) Foreign Application Priority Data

Nov. 11, 2020 (JP) ..... 2020-187749

(51) Int. Cl.

| | |
|---|---|
| ***C10M 173/02*** | (2006.01) |
| ***C10M 105/14*** | (2006.01) |
| ***C10M 129/93*** | (2006.01) |
| ***C10M 137/10*** | (2006.01) |
| ***C10M 141/10*** | (2006.01) |
| *C10N 40/08* | (2006.01) |

(52) U.S. Cl.

CPC ..... *C10M 173/02* (2013.01); *C10M 105/14* (2013.01); *C10M 129/93* (2013.01); *C10M 137/105* (2013.01); *C10M 141/10* (2013.01); *C10M 2201/02* (2013.01); *C10M 2207/0225* (2013.01); *C10M 2207/129* (2013.01); *C10M 2223/047* (2013.01); *C10N 2040/08* (2013.01)

(58) Field of Classification Search

CPC ..... C10M 173/02; C10M 105/14; C10M 129/93; C10M 137/105; C10M 141/10; C10M 2201/02; C10M 2207/0225; C10M 2207/129; C10M 2223/047; C10M 2201/062; C10M 2207/22; C10N 2040/08; C10N 2030/02; C10N 2030/06

See application file for complete search history.

(56) References Cited

U.S. PATENT DOCUMENTS

| | | | | | |
|---|---|---|---|---|---|
| 3,992,312 | A * | 11/1976 | Genjida | C10M 173/02 252/77 |
| 5,773,392 | A * | 6/1998 | Romanelli | C10M 137/105 508/348 |
| 5,922,657 | A * | 7/1999 | Camenzind | C10L 10/04 508/430 |
| 2009/0242858 | A1 | 10/2009 | Palmerio et al. | |
| 2016/0208193 | A1 | 7/2016 | Caskey, Jr. et al. | |
| 2023/0108871 | A1 | 4/2023 | Kaneko | |

FOREIGN PATENT DOCUMENTS

| | | | | |
|---|---|---|---|---|
| CN | 101173197 | A | 5/2008 | |
| CN | 10407333 | * | 10/2014 | |
| JP | H05263094 | A | 10/1993 | |
| JP | H07233391 | A | 9/1995 | |
| JP | 2646308 | B2 | 8/1997 | |
| JP | 3233490 | B2 | 11/2001 | |
| JP | 2007246684 | A | 9/2007 | |
| JP | 2015025114 | A | 2/2015 | |
| WO | WO-2014078702 | A1 * | 5/2014 | C10M 129/18 |

OTHER PUBLICATIONS

International Search Report and Written Opinion Received for PCT Patent Application No. PCT/EP2021/081109, Mailed on Jan. 31, 2022, 11 Pages.

Office Action Received for Japanese Application No. 2020-187749, Mailed on Sep. 17, 2024, 5 Pages (2 Pages of English Translation and 3 Pages of Official Copy).

* cited by examiner

*Primary Examiner* — Cephia D Toomer

(74) *Attorney, Agent, or Firm* — Shell USA, Inc.

(57) ABSTRACT

This invention provides a water-glycol hydraulic fluid comprises from 0.2 to 0.6% by mass of a dimer acid as a fatty acid lubricant, and more than 0.10% by mass and 0.20% by mass or less of a phosphoric acid ester of Formula (1), wherein the sum of the dimer acid and the phosphoric acid ester is more than 0.35% by mass wherein $R_1$ and $R_2$ may be the same or different, each representing a hydrogen atom or a hydrocarbon group having from 1 to 30 carbon atoms, $R_3$ represents a hydrocarbon group having from 1 to 20 carbon atoms, $R_4$ represents a hydrogen atom or a hydrocarbon group having from 1 to 30 carbon atoms, and $X_1$, $X_2$, $X_3$ and $X_4$ may be the same or different, each representing an oxygen atom or a sulfur atom.

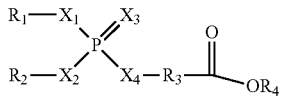

(1)

2 Claims, No Drawings

WATER-GLYCOL HYDRAULIC FLUID

CROSS REFERENCE TO RELATED APPLICATIONS

This is a National stage application of International Application No. PCT/EP2021/081109, filed 9 Nov. 2021, which claims priority of Japanese Patent Application No. 2020-187749, filed 11 Nov. 2020 which is incorporated herein by reference in its entirety.

FIELD OF THE INVENTION

The present invention relates to an improved water-glycol hydraulic fluid.

BACKGROUND OF THE INVENTION

Hydraulic equipment is used widely in industry, where it contributes to improvements in productivity, and is also used widely by the general public. Hydraulic fluids are used as the medium for transmitting power in hydraulic equipment, and petroleum-based hydraulic oils using a mineral oil-based base oil, such as a highly refined paraffin-based base oil, are generally used as hydraulic oils.

However, hydraulic equipment used in mechanical equipment such as die casting machinery, forging presses, steel-making equipment used in the steel industry where fire resistance is required, and hydraulic equipment used in amusement park equipment and stage equipment in indoor facilities where fire safety is important, cannot use petroleum-based hydraulic oils, so water-glycol hydraulic fluids are used as they are flame-retardant water-based hydraulic fluids.

When a water-glycol hydraulic fluid is used as a water-based hydraulic fluid, good wear resistance and lubricity are required so that hydraulic operations can be performed smoothly and the service life of hydraulic equipment can be extended. Therefore, water-based hydraulic fluid compositions obtained by, for example, adding a polyoxyalkylene glycol diether compound having a specific structure, a polyoxyalkylene glycol monoether compound, a polyoxypropylene glycol monoether compound, and a fatty acid salt to water are used to improve performance in terms of lubricity and wear resistance as described in JP3233490 B2.

Some water-glycol hydraulic fluids also include a small amount of a neutralization product of glycerol borate and a base obtained by reacting glycerol with boric anhydride or boron trichloride, see for example JP2646308 B2. (Patent Document 2) Other water-glycol hydraulic fluids, as described in JP H07-233391 A, contain a water-soluble polyether having a specific structure derived from a water-soluble polyoxyalkylene polyol and glycidyl ether.

It is an object of the present invention to obtain a high-performance water-glycol hydraulic fluid having greatly improved wear resistance without impairing any other type of performance provided by the water-glycol hydraulic fluid by including specific additives in the water-glycol hydraulic fluid.

SUMMARY OF THE INVENTION

Specifically, the present invention is a water-glycol hydraulic fluid comprising from 20 to 60% by mass of water, 0.2 to 0.6% by mass of a dimer acid as a fatty acid lubricant, and more than 0.10% by mass and 0.20% by mass or less of a phosphoric acid ester, wherein the sum of the dimer acid and the phosphoric acid ester of structure [Formula 1] is more than 0.35% by mass,

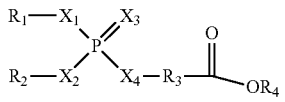

(1)

wherein, in this formula, $R_1$ and $R_2$ may be the same or different, each representing a hydrogen atom or a hydrocarbon group having from 1 to 30 carbon atoms, $R_3$ represents a hydrocarbon group having from 1 to 20 carbon atoms, $R_4$ represents a hydrogen atom or a hydrocarbon group having from 1 to 30 carbon atoms, and $X_1$, $X_2$, $X_3$ and $X_4$ may be the same or different, each representing an oxygen atom or a sulfur atom.

DETAILED DESCRIPTION OF THE INVENTION

The present invention provides a water-glycol hydraulic fluid containing from 20 to 60% by mass water and from 20 to 60% by mass glycol, along with, for example, a fatty acid-based lubricant, an alkaline hydroxide compound, a thickener, a rust inhibitor, an anticorrosive, and an antifoaming agent to bring the total to 100% by mass. As a result of extensive research and development conducted to solve this problem, the present inventor discovered that use of a dimer acid as a fatty acid-based lubricant and a phosphoric acid ester with a specific structure could significantly improve the wear resistance of a water-glycol hydraulic fluid. The present invention is based on this discovery.

By using this configuration, the present invention is able to readily obtain an easy-to-use water-glycol hydraulic fluid with significantly improved wear resistance without impairing any other type of performance provided by the water-glycol hydraulic fluid.

A fatty acid lubricant is used in a water-glycol hydraulic fluid of the present invention, and a dimer acid is used as this fatty acid lubricant. This dimer acid is a dimer of an unsaturated fatty acid having 18 carbon atoms, and is mainly composed of a dibasic acid of a dicarboxylic acid having 36 carbon atoms produced by dimerization of an unsaturated fatty acid having 18 carbon atoms derived from plant-based fats and oils. It is a liquid fatty acid containing a monobasic acid and a tribasic acid.

This dimer acid is included in an amount of 0.2% by mass or more and 0.6% by mass or less relative to the total mass of the water-glycol hydraulic fluid composition. When less than 0.2% by mass is used, sufficient wear resistance cannot be obtained. When more than 0.6% by mass is used, sludge is more likely to be produced.

This water-glycol hydraulic fluid also contains a phosphoric acid ester. This phosphoric acid ester is represented by the Formula (1) below:

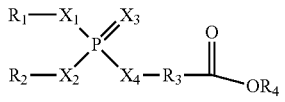

(1)

In this general formula, $R_1$ and $R_2$ each represent a hydrogen atom or a hydrocarbon group having from 1 to 30 carbon atoms. Here, $R_1$ and $R_2$ may be the same or different. $R_3$ represents a hydrocarbon group having from 1 to 20 carbon atoms, and $R_4$ represents a hydrogen atom or a hydrocarbon group having from 1 to 30 carbon atoms. $X_1$, $X_2$, $X_3$ and $X_4$ may be the same or different and each represents an oxygen atom or a sulfur atom.

This phosphoric acid ester is included in an amount of more than 0.10% by mass and 0.20% by mass or less relative to the total mass of the water-glycol hydraulic fluid composition, and the sum of the dimer acid and the phosphoric acid ester is more than 0.35% by mass. The phosphoric acid ester is preferably used in an amount of 0.12% by mass or more, and more preferably in an amount of 0.15% by mass or more.

The glycols in this water-glycol hydraulic fluid composition can be, for example, ethylene glycol, propylene glycol, butylene glycol, hexylene glycol, diethylene glycol, dipropylene glycol, dibutylene glycol, dihexylene glycol, trimethylene glycol, triethylene glycol, and tripropylene glycol. One type of glycol can be used alone, or a mixture of two or more types of glycol can be used. Use of propylene glycol or dipropylene glycol is preferred. These glycols are included in an amount from 20 to 60% by mass, and preferably from 30 to 50% by mass, relative to the total mass of the water-glycol hydraulic fluid composition.

An alkanolamine can be used as a rust inhibitor. Examples of alkanolamines include methanolamine, ethanolamine, propanolamine, diethanolamine, triethanolamine, dimethylethanolamine, N-methylethanolamine, N-methyldiethanolamine, N,N-dimethylaminoethanol, N,N-diethylaminoethanol, N,N-dipropylaminoethanol, N,N-dibutylaminoethanol, N,N-dipentylaminoethanol, N,N-dihexylaminoethanol, N,N-diheptylaminoethanol, and N,N-dioctylaminoethanol. The alkanolamine is included in an amount of 1.0 to 5.0% by mass based on the total mass of the composition.

The alkaline hydroxide compounds mentioned above are potassium hydroxide and sodium hydroxide, and these may be used alone or together. The alkaline hydroxide compound is included in an amount from 0.01 to 0.12% by mass, and preferably from 0.04 to 0.06% by mass, relative to the total mass of the composition.

Well-known additives can be included in the water-glycol hydraulic fluid if necessary. Examples include thickeners, lubricants, metal deactivators, anti-wear agents, extreme pressure agents, dispersants, metal detergents, friction modifiers, corrosion inhibitors, anti-emulsifiers, and defoamers. These additives may be used alone or in combinations of more than one. An additive package for a water-glycol hydraulic fluid may also be used.

EXAMPLES

Water-glycol hydraulic fluids of the present invention will now be described in detail with reference to examples and comparative examples. The present invention is not limited to these examples. The components were thoroughly mixed together in the amounts shown in Table 1 and Table 2 to obtain the water-glycol hydraulic fluids in Examples 1 to 7.

Example 1

A water-glycol hydraulic fluid was obtained by thoroughly mixing together 0.20% by mass dimer acid, 0.20% by mass 3-(di-isobutoxy-thiophosphorylsulfanyl)-2-methylpropionic acid serving as the phosphoric acid ester, 38.628% by mass propylene glycol serving as the glycol, 16.10% by mass of water-soluble polymer serving as a thickener, a total of 2.565% by mass of other additives such as sodium hydroxide, a corrosion inhibitor, and a defoamer, etc., and 42.307% by mass water. The alkali reserve of the water-glycol hydraulic fluid obtained in accordance with JIS K2234-1994 was 20, the 40° C. kinematic viscosity was 46 $mm^2/s$, and the pH was 10.6.

The phosphoric acid ester used in Example 1 is represented by the following structural formula:

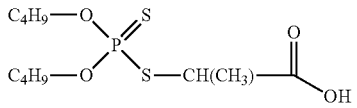

Example 2

A water-glycol hydraulic fluid was obtained in the same manner as Example 1 using 0.30% by mass dimer acid, 0.15% by mass of the phosphoric acid ester described above, and 42.257% by mass water. The alkali reserve of the water-glycol hydraulic fluid obtained in accordance with JIS K2234-1994 was 20, and the 40° C. kinematic viscosity was 46 $mm^2/s$.

Example 3

A water-glycol hydraulic fluid was obtained in the same manner as Example 1 using 0.30% by mass dimer acid, 0.20% by mass of the phosphoric acid ester described above, and 42.207% by mass water. The alkali reserve of the water-glycol hydraulic fluid obtained in accordance with JIS K2234-1994 was 20, and the 40° C. kinematic viscosity was 46 $mm^2/s$.

Example 4

A water-glycol hydraulic fluid was obtained in the same manner as Example 1 using 0.40% by mass dimer acid, 0.15% by mass of the phosphoric acid ester described above, and 42.157% by mass water. The alkali reserve of the water-glycol hydraulic fluid obtained in accordance with JIS K2234-1994 was 20, and the 40° C. kinematic viscosity was 46 $mm^2/s$.

Example 5

A water-glycol hydraulic fluid was obtained in the same manner as Example 1 using 0.40% by mass dimer acid, 0.20% by mass of the phosphoric acid ester described above, and 42.107% by mass water. The alkali reserve of the water-glycol hydraulic fluid obtained in accordance with JIS K2234-1994 was 20, and the 40° C. kinematic viscosity was 46 $mm^2/s$.

Example 6

A water-glycol hydraulic fluid was obtained in the same manner as Example 1 using 0.60% by mass dimer acid, 0.15% by mass of the phosphoric acid ester described above, and 41.957% by mass water. The alkali reserve of the water-glycol hydraulic fluid obtained in accordance with JIS K2234-1994 was 20, and the 40° C. kinematic viscosity was 46 $mm^2/s$.

Example 7

A water-glycol hydraulic fluid was obtained in the same manner as Example 1 using 0.60% by mass dimer acid, 0.20% by mass of the phosphoric acid ester described above, and 41.907% by mass water. The alkali reserve of the water-glycol hydraulic fluid obtained in accordance with JIS K2234-1994 was 20, and the 40° C. kinematic viscosity was 46 $mm^2/s$.

Comparative Example 1

A water-glycol hydraulic fluid was obtained in the same manner as Example 1 using 0.20% by mass dimer acid, 0.05% by mass of the phosphoric acid ester described above, and 42.457% by mass water. The alkali reserve of the water-glycol hydraulic fluid obtained in accordance with JIS K2234-1994 was 20, and the 40° C. kinematic viscosity was 46 $mm^2/s$.

Comparative Examples 3 to 5

The components were thoroughly mixed together in the amounts shown in Table 3 to obtain the water-glycol hydraulic fluids in the same manner as Example 1. The alkali reserve of the water-glycol hydraulic fluids in Comparative Examples 2 to 5 obtained in accordance with JIS K2234-1994 was 20, and the 40° C. kinematic viscosity was 46 $mm^2/s$.

The following test was performed on the examples and comparative examples to evaluate the wear resistance and lubricity performance.

Shell Four Ball Lubricant Test

The operations were performed at room temperature for 30 minutes in accordance with ASTM D4172, in which the spindle rotation speed was 1,500 rpm and the load was 40 kgf. Afterwards, the diameter (mm) of the wear marks on the steel balls was measured. The test results are shown in Table 1 to Table 3.

Evaluation Standards:

Wear mark diameter≤0.65 mm . . . Passed (○)

Wear mark diameter>0.65 mm . . . Failed (x)

Observations

As shown in Table 1 and Table 2, in Examples 1 to 7, which contained 0.20% by mass or more and 0.60% by mass or less of a dimer acid and more than 0.15% by mass and 0.20% by mass or less of a phosphoric acid ester, with the sum of the dimer acid and the phosphoric acid ester being more than 0.35% by mass, the wear mark diameter in the Shell four ball lubricant test was 0.65 mm or less, which indicates superior wear resistance and lubricity.

As shown in Table 3, in Comparative Examples 1, 2, 4 and 5, which contained 0.2% by mass or more and 0.6% by mass or less of a dimer acid but less than 0.10% by mass of a phosphoric acid ester, and in Comparative Example 3, which contained more than 0.10% by mass of a phosphoric acid ester but with the sum of the dimer acid and the phosphoric acid ester being less than 0.35% by mass, the wear mark diameter in the Shell four ball lubricant test was 0.681 mm or more, which indicates poor results. In the case of Comparative Example, 1, scorching occurred.

TABLE 1

| | Example 1 | Example 2 | Example 3 |
|---|---|---|---|
| Dimer Acid | 0.20 | 0.30 | 0.30 |
| Phosphoric Acid Ester | 0.20 | 0.15 | 0.20 |
| Glycol | 38.628 | 38.628 | 38.628 |
| Thickener | 16.100 | 16.100 | 16.100 |
| Other Additives | 2.565 | 2.565 | 2.565 |
| Water | 42.307 | 42.257 | 42.207 |
| Diameter of Wear Marks (mm) | 0.643 | 0.621 | 0.618 |
| Evaluation | ○ | ○ | ○ |

TABLE 2

| | Example 4 | Example 5 | Example 6 | Example 7 |
|---|---|---|---|---|
| Dimer Acid | 0.40 | 0.40 | 0.60 | 0.60 |
| Phosphoric Acid Ester | 0.15 | 0.20 | 0.15 | 0.20 |
| Glycol | 38.628 | 38.628 | 38.628 | 38.628 |
| Thickener | 16.100 | 16.100 | 16.100 | 16.100 |
| Other Additives | 2.565 | 2.565 | 2.565 | 2.565 |
| Water | 42.157 | 42.107 | 41.957 | 41.907 |
| Diameter of Wear Marks (mm) | 0.535 | 0.547 | 0.526 | 0.484 |
| Evaluation | ○ | ○ | ○ | ○ |

TABLE 3

| | C. Ex. 1 | C. Ex. 2 | C. Ex. 3 | C. Ex. 4 | C. Ex. 5 |
|---|---|---|---|---|---|
| Dimer Acid | 0.20 | 0.20 | 0.20 | 0.40 | 0.60 |
| Phosphoric Acid Ester | 0.05 | 0.10 | 0.15 | 0.10 | 0.10 |
| Glycol | 38.628 | 38.628 | 38.628 | 38.628 | 38.628 |
| Thickener | 16.100 | 16.100 | 16.100 | 16.100 | 16.100 |
| Other Additives | 2.565 | 2.565 | 2.565 | 2.565 | 2.565 |
| Water | 42.457 | 42.407 | 42.357 | 42.207 | 42.007 |
| Diameter of Wear Marks (mm) | Scorched | 0.837 | 0.681 | 0.725 | 0.685 |
| Evaluation | x | x | x | x | x |

I claim:

1. A water-glycol hydraulic fluid comprising:

from 20 to 60% by mass of water and from 20 to 60% by mass of glycol;

0.2% by mass or more and 0.6% by mass or less of a dimer acid as a fatty acid lubricant, wherein the dimer acid is a dibasic acid of a dicarboxylic acid having 36 carbon atoms; and from 0.15% to 0.20% by mass of a phosphoric acid ester represented by general formula (1) below,

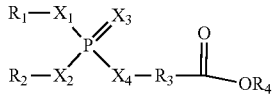

(1)

wherein $R_1$ and $R_2$ may be the same or different, each representing a hydrogen atom or a hydrocarbon group having from 1 to 30 carbon atoms, $R_3$ represents a hydrocarbon group having from 1 to 20 carbon atoms, $R_4$ represents a hydrogen atom or a hydrocarbon group having from 1 to 30 carbon atoms, and $X_1$, $X_2$, $X_3$ and $X_4$ may be the same or different, each representing an oxygen atom or a sulfur atom, and wherein the sum of the dimer acid and the phosphoric acid ester is more than 0.35% by mass.

2. The water-glycol hydraulic fluid according to claim 1, wherein $X_1$ and $X_2$ in the phosphoric acid ester are oxygen atoms, $X_3$ and $X_4$ are sulfur atoms, and $R_3$ is —CH(CH3)- or —CH2-CH2-.

* * * * *